US008872724B2

(12) United States Patent
Lee

(10) Patent No.: US 8,872,724 B2
(45) Date of Patent: Oct. 28, 2014

(54) MOBILE COMMUNICATION TERMINAL CASING EQUIPPED WITH INTERNAL ANTENNA

(75) Inventor: Sang Hoon Lee, Seoul (KR)

(73) Assignee: AQ Corporation, Suwon-Si (KR)

( * ) Notice: Subject to any disclaimer, the term of this patent is extended or adjusted under 35 U.S.C. 154(b) by 650 days.

(21) Appl. No.: 13/113,400

(22) Filed: May 23, 2011

(65) Prior Publication Data

US 2012/0068908 A1 Mar. 22, 2012

(30) Foreign Application Priority Data

Sep. 16, 2010 (KR) ..... 10-2010-0091269

(51) Int. Cl.
*H01Q 1/40* (2006.01)
*H01Q 1/24* (2006.01)

(52) U.S. Cl.
CPC . *H01Q 1/40* (2013.01); *H01Q 1/243* (2013.01)
USPC ..... 343/873; 343/872

(58) Field of Classification Search
USPC ..... 343/872–873
See application file for complete search history.

(56) References Cited

U.S. PATENT DOCUMENTS

2009/0268423 A1* 10/2009 Sakurai et al. ..... 361/803
2010/0216520 A1* 8/2010 Lee ..... 455/572

* cited by examiner

*Primary Examiner* — Matthew Mikels
(74) *Attorney, Agent, or Firm* — Knobbe, Martens, Olson & Bear, LLP

(57) ABSTRACT

Disclosed herein is a mobile communication terminal casing equipped with an internal antenna. The mobile communication terminal casing includes an antenna sheet having contact terminals, and an injection-molded casing product including an inner surface having an internal groove that is coupled to the antenna sheet and an outer surface opposite to the inner surface. A second surface opposite to a first surface of the antenna sheet on which the contact terminals are located comes into contact with the internal groove of the injection-molded casing product, and the first surface is injection-molded to be exposed outside of the injection-molded casing product.

20 Claims, 5 Drawing Sheets

MOBILE COMMUNICATION TERMINAL CASING EQUIPPED WITH INTERNAL ANTENNA

CROSS-REFERENCE TO RELATED APPLICATIONS

This application claims priority under 35 U.S.C. §119 to Korean Patent Application No. 10-2010-0091269, filed on Sep. 16, 2010, in the Korean Intellectual Property Office, the disclosure of which is incorporated herein by reference in its entirety.

BACKGROUND OF THE INVENTION

1. Field of the Invention

The present invention relates to a mobile communication terminal casing equipped with an internal antenna.

2. Description of the Related Art

Generally, an antenna is a high-frequency device that functions to convert electrical signals containing information into radio waves and transmit the radio waves into space, or to receive radio waves containing information from space and convert the radio waves into electrical signals. Such an antenna functions as an interface between the internal circuit and the outer space of a mobile communication terminal.

In the conventional art, an intenna (internal antenna) electrode has been formed using a method of inserting an intenna sheet into a mold and injection-molding the intenna sheet from the rear surface of the mold. However, such a method is problematic in that forming electrodes involves many difficulties, and a method of inserting electrodes is complicated.

Further, conventional antennas are problematic in that radiation efficiency is deteriorated, bandwidth is narrow, and antenna gain is low. However, even if the electrical performance of conventional antennas is deteriorated, the realization of a small size, multi-functionality and high-performance has been continuously required in the market for mobile communication terminals.

In relation to such a problem, there is a recent tendency to place more importance of the design of communication terminals, and thus the use of an internal antenna, rather than the use of an external antenna which protrudes outwardly, has increased. However, it is very difficult for an internal antenna to obtain high gain due to the limited space and the electrical parts of a Printed Circuit Board (PCB).

As conventional technologies related to a casing-integrated antenna according to the present invention, various technologies have been presented, and include Korean Patent Laid-open Publication No. 10-2009-0079720 (Publication date: Jul. 22, 2009) entitled "mobile terminal having an external casing-integrated broadcasting reception antenna", Korean Patent Registration No. 10-0905858 (Registration date: Jun. 25, 2009) entitled "casing-integrated antenna and method of manufacturing the same"), Korean Patent Registration No. 10-0910161 (Registration date: Jul. 24, 2009) entitled "internal antenna-integrated mobile terminal casing and method of manufacturing the same." However, as described above, most of the conventional technologies are problematic because it is difficult to form electrodes and it is complicated to insert the electrodes.

SUMMARY OF THE INVENTION

According to an aspect of the present invention, a mobile communication terminal casing, including an antenna sheet having contact terminals, the antenna sheet having a first surface on which the contact terminal is located and a second surface opposite to the first surface; and an injection-molded casing product including an inner surface having an internal groove that is coupled to the antenna sheet and an outer surface opposite to the inner surface, the second surface of the antenna sheet being in contact with the internal groove of the injection-molded casing product, the first surface of the antenna sheet exposed outside of the injection-molded casing product.

According to an embodiment of the present invention, the first surface of the antenna sheet on which the contact terminals are located may be located on a same plane as the inner surface of the injection-molded casing product.

According to an embodiment of the present invention, the antenna sheet may include a first protective film; an antenna pattern formed to be in close contact with a bottom surface of the first protective film; a plurality of contact terminals configured to input or output signals to or from the antenna pattern; and a second protective film provided with first connection holes formed at locations corresponding to the plurality of contact terminals and formed to be in close contact with a bottom surface of the antenna pattern.

According to an embodiment of the present invention, the mobile communication terminal casing may further include one or more through-holes formed through the first protective film, the antenna pattern, and the second protective film so that an injection agent can be injected therethrough.

According to an embodiment of the present invention, the antenna sheet may include a first protective film; an antenna pattern formed to be in close contact with a bottom surface of the first protective film; a plurality of contact terminals configured to input or output signals to or from the antenna pattern; a second protective film provided with first connection holes formed at locations corresponding to those of the plurality of contact terminals and formed to be in close contact with a bottom surface of the antenna pattern; and an absorber provided with second connection holes formed at locations corresponding to those of the plurality of contact terminals and formed to be in close contact with a bottom surface of the second protective film so that the absorber is applied in a form of ink or attached in a form of a film and attenuates electromagnetic waves.

According to an embodiment of the present invention, the mobile communication terminal casing may further include one or more through-holes formed through the first protective film, the antenna pattern, the second protective film, and the absorber so that an injection agent can be injected therethrough.

According to an embodiment of the present invention, the antenna sheet may include a first protective film; an antenna pattern formed to be in close contact with a bottom surface of the first protective film; a plurality of contact terminals configured to input or output signals to or from the antenna pattern; a second protective film provided with first connection holes formed at locations corresponding to those of the plurality of contact terminals and formed to be in close contact with a bottom surface of the antenna pattern; and a binder formed on a top surface of the first protective film so that the first protective film is easily coupled to the injection-molded casing product.

According to an embodiment of the present invention, the mobile communication terminal casing may further include one or more through-holes formed through the first protective film, the antenna pattern, the second protective film, and the binder so that an injection agent can be injected therethrough.

According to an embodiment of the present invention, the mobile communication terminal casing may further include an absorber provided with second connection holes formed at locations corresponding to those of the plurality of contact terminals and formed to be in close contact with a bottom surface of the second protective film so that the absorber is applied in a form of ink or attached in a form of a film and attenuates electromagnetic waves.

According to an embodiment of the present invention, the mobile communication terminal casing may further include one or more through-holes formed through the first protective film, the antenna pattern, the second protective film, the binder, and the absorber so that an injection agent can be injected therethrough.

According to an embodiment of the present invention, binding processing may be performed on the first protective film has a top surface so that the first protective film is easily coupled to the injection-molded casing product.

According to an embodiment of the present invention, the antenna sheet may include one or more of a Mobile (M)-commerce antenna or a Near-Field Communication (NFC) antenna which uses a 13.56 MHz band, a Digital Multimedia Broadcasting (DMB) antenna, a WiFi antenna, a Global Positioning System (GPS) antenna, a Bluetooth antenna, a Frequency Modulation (FM) transceiver antenna, and an Ultra-Wideband (UWB) antenna.

According to an aspect of the present invention, a mobile communication terminal casing, includes: an antenna sheet including: a first protective film; an antenna pattern formed to be in contact with a bottom surface of the first protective film; a second protective film provided with first connection holes and formed to be in contact with a bottom surface of the antenna pattern; contact terminals formed in the first connection holes to input or output signals to or from the antenna pattern; and a through-hole formed through the first protective film, the antenna pattern, and the second protective film; and an injection-molded casing product including an inner surface having an internal groove to receive the antenna sheet and an outer surface opposite to the inner surface, the first protective film being in contact with the internal groove of the injection-molded casing product, a bottom surface of the second protective film exposed outside of the injection-molded casing product.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1A:
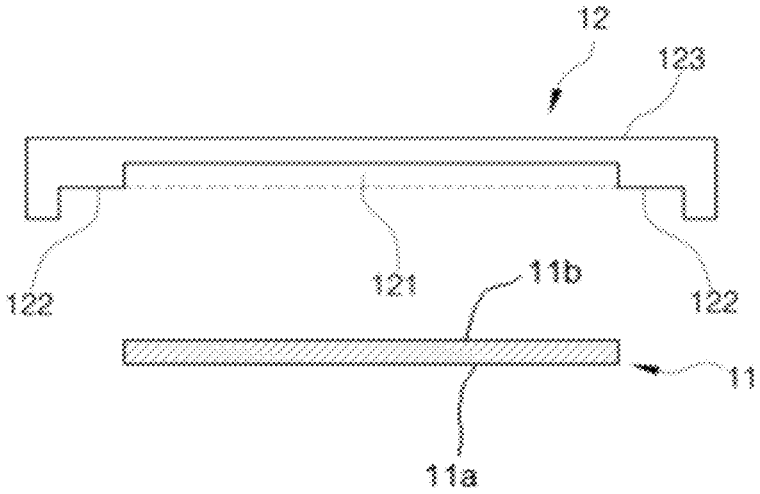
FIG. 1A is an exploded view showing a mobile communication terminal casing equipped with an internal antenna according to an embodiment of the present invention.

The present invention can be variously modified and can be implemented in various embodiments. Although specific embodiments are illustrated in the drawings and will be described in detail in the detailed description of the invention, it should be understood that the embodiments are not intended to limit the present invention to specific embodiments, and the present invention includes all modifications, equivalents or substitutions included in the range of the spirit and scope of the present invention. If in the specification, detailed descriptions of well-known functions or configurations may unnecessarily make the gist of the present invention obscure, the detailed descriptions will be omitted.

The terms "first" and "second" can be used to describe various components, but the components of the invention should not be limited by the terms. The terms are used merely to differentiate one component from other components.

The terms in the present specification are intended only to describe specific embodiments and are not intended to limit the present invention. The representation of the singular form includes the representation of the plural form unless it definitely represents a different meaning given the context. In the present specification, the term "including" or "having" is intended only to indicate that features, numbers, steps, operations, components, parts or combinations thereof described in the specification are present, and it should be understood that a possibility that one or more other features, numbers, steps, operations, components, parts or combinations thereof will be present or added is not excluded in advance.

Hereinafter, embodiments of a mobile communication terminal casing equipped with an internal antenna according to the present invention will be described in detail with reference to the attached drawings. Reference now should be made to the drawings, in which the same reference numerals are used throughout the different drawings to designate the same or similar components, and a repeated description of the same or similar components will be omitted here.

Figure 1B:
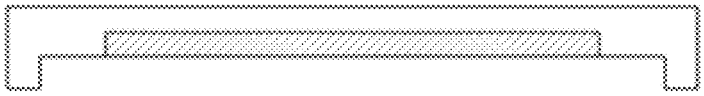
FIG. 1B is a sectional view showing the mobile communication terminal casing equipped with the internal antenna according to an embodiment of the present invention.
Figure 2A:
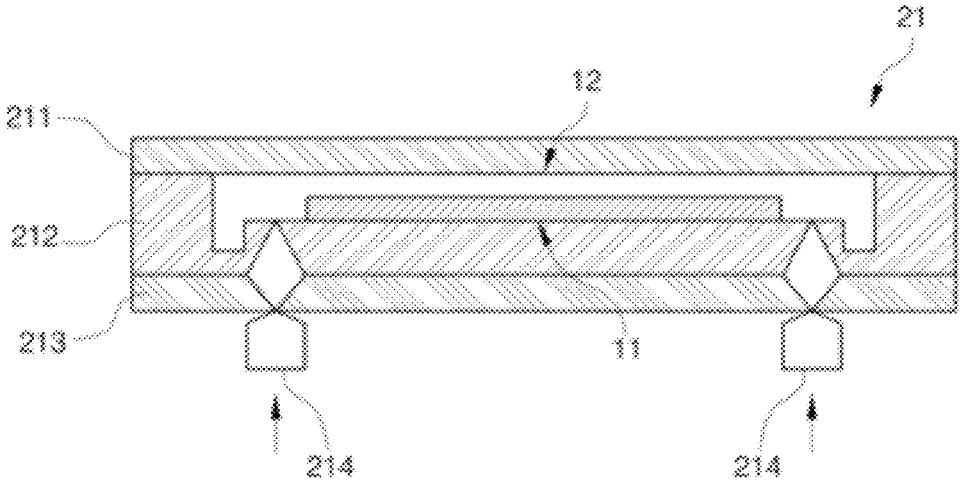
FIG. 2A is a sectional view showing the structure of a mold for injection-molding the mobile communication terminal casing equipped with the internal antenna according to an embodiment of the present invention.
Figure 2B:
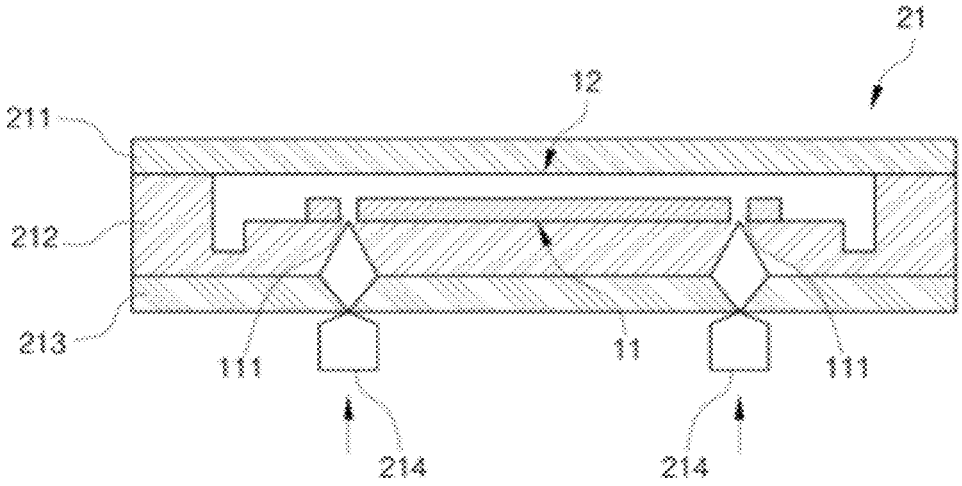
FIG. 2B is a sectional view showing the structure of a mold for injection-molding the mobile communication terminal casing equipped with the internal antenna according to another embodiment of the present invention.
Figure 3A:
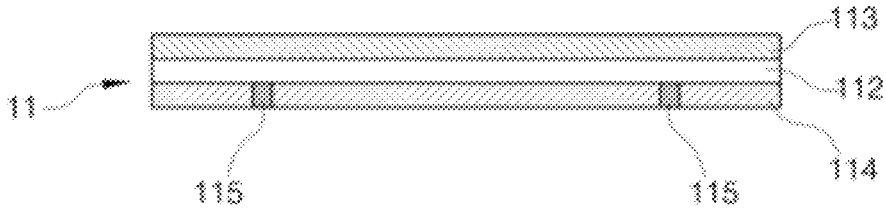
FIG. 3A is a sectional view showing an antenna sheet according to a first embodiment of the present invention.
Figure 3B:
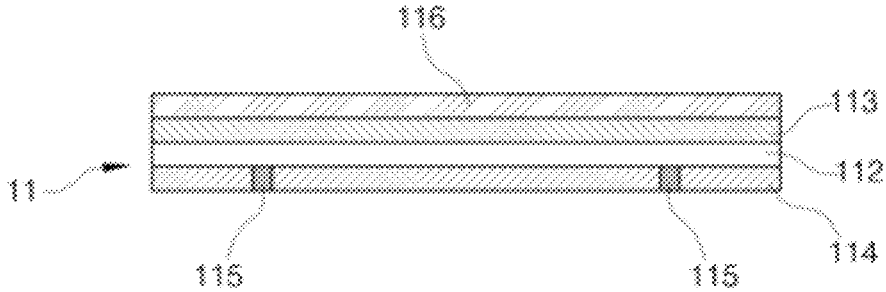
FIG. 3B is a sectional view showing the antenna sheet according to a second embodiment of the present invention.
Figure 4A:
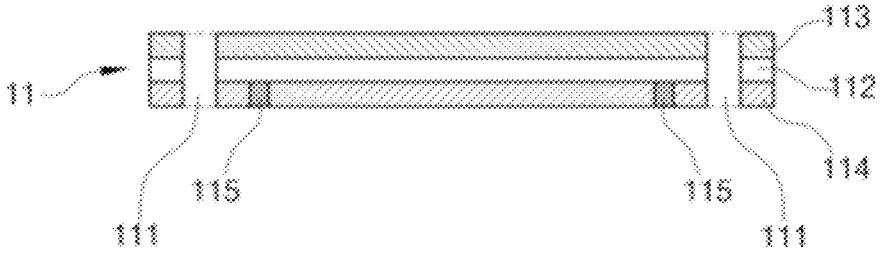
FIG. 4A is a sectional view showing the antenna sheet according to a third embodiment of the present invention.
Figure 4B:
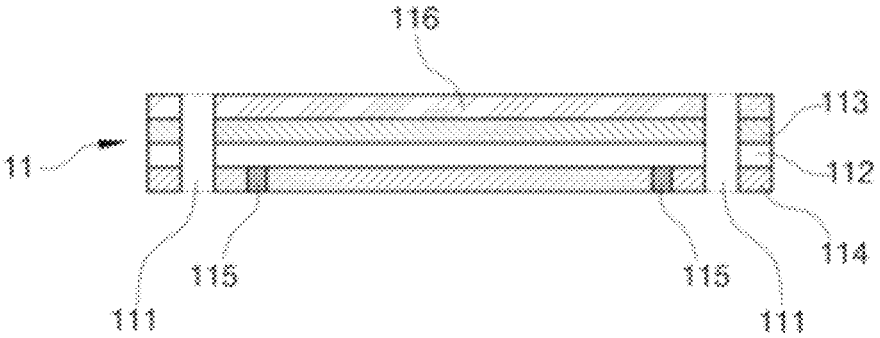
FIG. 4B is a sectional view showing the antenna sheet according to a fourth embodiment of the present invention.
Figure 5:
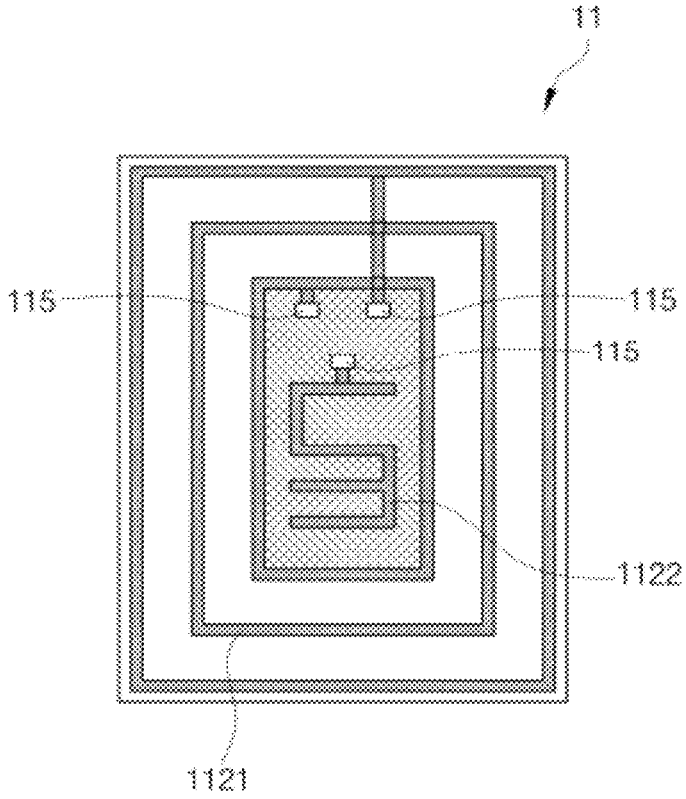
FIG. 5 shows a plurality of antennas formed in an antenna sheet according to an embodiment of the present invention.

FIG. 1A is an exploded view showing a mobile communication terminal casing equipped with an internal antenna according to an embodiment of the present invention, and FIG. 1B is a sectional view showing the mobile communication terminal casing equipped with the internal antenna according to an embodiment of the present invention. FIG. 2A is a sectional view showing the structure of a mold required to injection-mold the mobile communication terminal casing equipped with the internal antenna according to an embodiment of the present invention, and FIG. 2B is a sectional view showing the structure of a mold required to injection-mold the mobile communication terminal casing equipped with the internal antenna according to another embodiment of the present invention. FIG. 3A is a sectional view showing an antenna sheet according to a first embodiment of the present invention, FIG. 3B is a sectional view showing the antenna sheet according to a second embodiment of the present invention, FIG. 4A is a sectional view showing the antenna sheet according to a third embodiment of the present invention, and FIG. 4B is a sectional view showing the antenna sheet according to a fourth embodiment of the present invention. FIG. 5 is a diagram showing a plurality of antennas formed in an antenna sheet according to an embodiment of the present invention.

Referring to FIGS. 1A and 1B, a mobile communication terminal casing equipped with an internal antenna according to an embodiment of the present invention may include an antenna sheet 11 and an injection-molded casing product 12.

The antenna sheet 11 may include a first surface and a second surface. The first surface 11*a* may be a portion on which contact terminals are located, and the second surface 11*b* is a surface opposite the first surface and may be a portion which comes into contact with the internal groove 121 of the injection-molded casing product 12, which will be described later.

The detailed structure of the antenna sheet 11 will be described later.

The injection-molded casing product 12 may be formed in such a way that the antenna sheet 11 is located in a mold and a molding material is injected into the mold.

The injection-molded casing product 12 may include an inner surface 122 having the internal groove 121 coupled to the antenna sheet 11, and an outer surface 123 which is the external surface of the mobile communication terminal.

The mobile communication terminal casing equipped with the internal antenna according to an embodiment of the present invention is injection-molded so that the second surface 11*b* of the antenna sheet 11 comes into contact with the internal groove 121 of the injection-molded casing product 12, and thus the second surface 11*b* may be covered with the injection-molded casing product 12. The first surface 11*a* of the antenna sheet 11 on which the contact terminals are located may be formed such that it is exposed outside in the direction in which the inner surface 122 of the injection-molded casing product 12 is located.

Accordingly, the mobile communication terminal casing equipped with the internal antenna according to an embodiment of the present invention is advantageous in that the first surface 11*a* of the antenna sheet 11 on which the contact terminals are located is exposed outside in the direction of the inner surface 122 of the injection-molded casing product 12, corresponding to the inner surface of the mobile communication terminal casing, thus enabling electrodes to be simply formed.

Referring to FIGS. 2A and 2B, a mold 21 for injection-molding the mobile communication terminal casing equipped with the internal antenna according to an embodiment of the present invention may include a first mold part 211, a second mold part 212, a third mold part 213, and nozzles 214.

The first mold part 211 forms the top of the mold 21, and comes into contact with the outer surface 123 of the injection-molded casing product 12, so that a molding material is injected into the mold 21 with the result that the outer surface 123 of the injection-molded casing product 12 can be formed.

The second mold part 212 is located beneath the first mold part 211, and may include a cavity, the shape of which is identical to the shape of the mobile communication terminal casing.

Further, the second mold part 212 may have spaces (gates) in which the molding material can be injected into the mobile communication terminal casing-shaped cavity through the nozzles 214.

The third mold part 213 is located beneath the second mold part 212, and may be connected to a molding material storage unit via the nozzles 214 so that the molding material can be injected into the mobile communication terminal casing-shaped cavity.

The nozzles 214 are located beneath the third mold part 213 and are configured to allow the molding material to be injected from the molding material storage unit into the mobile communication terminal casing-shaped cavity.

A procedure for manufacturing the mobile communication terminal casing equipped with the internal antenna according to an embodiment of the present invention will be described below.

First, the antenna sheet 11 may be disposed in the mobile communication terminal casing-shaped cavity of the second mold part 212.

In this case, the antenna sheet 11 may be disposed so that the first surface 11*a* thereof on which the contact terminals are located comes into contact with the boundary of the mobile communication terminal casing-shaped cavity of the second mold part 212.

The molding material may be injected into the mobile communication terminal casing-shaped cavity of the second mold part 212 via an area of the boundary of the mobile communication terminal casing-shaped cavity, which does not come into contact with the antenna sheet 11.

Meanwhile, the antenna sheet 11 may include contact terminals required to input or output signals to or from an antenna pattern, and through-holes 111 that are spaces through which the molding material is injected so as to injection-mold the injection-molded casing product 12.

Accordingly, the spaces enabling the molding material to be injected into the mobile communication terminal casing-shaped cavity of the second mold part 212 can be connected to the through-holes 111 of the antenna sheet 11.

In FIG. 2B, the case where there are two through-holes 111 is illustrated, but the present invention is not limited to this case, and the antenna sheet 11 may have one or more through-holes 111. In this case, it is apparent that the number of nozzles 214, the number of spaces enabling the molding material of the second mold part 212 to be injected into the mobile communication terminal casing-shaped cavity, and the number of spaces in the third mold part 213 may be identical to the number of the through-holes 111 of the antenna sheet 11.

Next, the first mold part 211, the second mold part 212, the third mold part 213, and the nozzles 214 of the mold 21 are coupled to one another. The molding material may be injected from the nozzles 214 located in a lower portion of the mold 21 into the mobile communication terminal casing-shaped cavity of the second mold part 212 at a uniform pressure, either via the area of the boundary of the mobile communication terminal casing-shaped cavity which does not come into contact with the antenna sheet 11, or via the through-holes 111 of the antenna sheet 11 when the antenna sheet 11 includes the through-holes 111.

After the injected molding material has been filled into the mobile communication terminal casing-shaped cavity of the second mold part 212, the mold 21 can be maintained at a uniform pressure.

If the molding material filled into the mobile communication terminal casing-shaped cavity of the second mold part 212 has cooled and hardened, and the molding material is then removed from the mold 21, the mobile communication terminal casing equipped with the internal antenna according to an embodiment of the present invention may be formed.

In this way, the mobile communication terminal casing equipped with the internal antenna according to the embodiment of the present invention is advantageous in that the first surface of the antenna sheet 11 on which contact terminals are located is exposed from the inner surface of the mobile communication terminal casing to the outside, thus enabling the formation of electrodes required for connection to the main body of the mobile communication terminal to be simplified. Further, there is an advantage in that the first surface on which the contact terminals are located is disposed to come into contact with the boundary of the mobile communication terminal casing-shaped cavity of the second mold part 212, so that the contact terminals do not come into contact with the molding material during an injection molding procedure, thus enabling a defective proportion to be remarkably decreased.

Meanwhile, the first surface of the antenna sheet 11 on which the contact terminals are located may preferably be formed so that the first surface is exposed outside while being disposed on the same plane as the inner surface 122 of the injection-molded casing product 12.

Referring to FIGS. 3A to 4B, the antenna sheet 11 may include an antenna pattern 112, a first protective film 113, a second protective film 114, and contact terminals 115.

The antenna pattern 112 is a pattern formed on the plane so that Radio Frequency (RF) signals for the mobile communication terminal are transmitted and received at the maximum gain, and may be implemented using a thin plate-shaped metal material having excellent conductivity.

As the metal material, a thin plate including one or more of copper, aluminum, gold, silver, an alloy, a conductive synthetic resin material, etc. can be used.

The antenna pattern 112 can be formed using any one selected from among pressing, etching, printing, bonding, etc., and can be formed to be in close contact with the first protective film 113.

Further, the antenna pattern 112 may include one or more of various antenna patterns which include patterns for a Mobile (M)-commerce antenna or a Near-Field Communication (NFC) antenna which uses a 13.56 MHz band, a Digital Multimedia Broadcasting (DMB) antenna, a WiFi antenna, a Global Positioning System (GPS) antenna, a Bluetooth antenna, a Frequency Modulation (FM) transceiver antenna, an Ultra-Wideband (UWB) antenna, etc.

That is, the reason that antenna patterns in a plurality of bands can be included in the single antenna sheet 11 in a state of electrical isolation is that the electrical lengths of the antennas resonating in respective bands differ.

Referring to FIG. 5, the antenna pattern 112 according to an embodiment of the present invention may include two antenna patterns corresponding to a first antenna 1121 and a second antenna 1122.

The first protective film 113 may be formed on the top surface of the antenna pattern 112 and may be configured to block physical, chemical, mechanical and electrical impacts that are externally applied, and to prevent the inflow of unnecessary impurities.

The magnitudes of impacts from which the antenna pattern 112 can be protected generally differ depending on the physical, chemical, mechanical, and electrical characteristics and the thickness of the first protective film 113.

The second protective film 114 may be made of a material having characteristics similar or identical to those of the first protective film 113. The second protective film 114 may be formed to be in close contact with the antenna pattern 112 in the state in which connection holes are formed in the second protective film 114 so as to make an electrical contact with contact terminals 115 from the outside of the antenna sheet 11. Like the first protective film 113, the second protection film 114 may be configured to prevent external impacts and protect the antenna pattern 112.

The contact terminals 115 may be formed as two terminals in a portion of the antenna pattern 112 and may make an electrical contact with the antenna pattern 112 to input RF transmission signals and output RF reception signals. Such a contact terminal 115 is preferably formed using plating.

As an example of the material used for plating, one or more selected from a group including gold, silver, lead, and an alloy may be used, and a kind of synthetic resin material having excellent conductivity may also be used.

Further, when the antenna pattern 112 includes two or more antennas, three or more contact terminals 115 may be formed.

Furthermore, the antenna sheet 11 according to another embodiment of the present invention is formed in a way that does not damage the antenna pattern 112, and may further include one or more through-holes 111 as holes formed through the antenna sheet 11.

Furthermore, the antenna sheet 11 according to a further embodiment of the present invention may further include a binder 116 formed on the top surface of the first protective film 113 so that the first protective film 113 is easily coupled to the injection-molded casing product 12.

The binder 116 may enable different types of materials to be easily coupled to each other under the high-temperature and high-pressure conditions of injection molding or the like.

That is, the binder 116 may be located on the top of the first protective film 113 and may function to exhibit the effect of sanding the smooth surface of the first protective film 113.

Meanwhile, in order for the first protective film 113 to be easily coupled to the injection-molded casing product 12, binding processing can be performed on the top surface of the first protective film 113 without the binder 116 being formed on the top surface of the first protective film 113.

A method of manufacturing the antenna sheet 11 according to an embodiment of the present invention will be described in detail.

First, the first protective film 113 for preventing external impacts is prepared.

The pattern 112 of the selected antenna is formed to be in close contact with the first protective film 113 using at least one method such as pressing, etching, printing, and bonding.

In this case, the antenna pattern 112 includes one or more selected from a group including an M-commerce antenna or an NFC antenna which uses a 13.56 MHz band, a DMB antenna, a WiFi antenna, a GPS antenna, a Bluetooth antenna, an FM transceiver antenna, and a UWB antenna. Two or more selected antennas can also be simultaneously formed.

From the standpoint of the maximal utilization of a limited area allowed by a small-sized terminal such as a mobile communication terminal, it is preferable to simultaneously configure two or more antennas.

The second protective film 114 for protecting the exposed antenna pattern 112 from external impacts in the state in which the antenna pattern 112 is in contact with the first protective film 113 is prepared.

Here, the first protective film 113 and the second protective film 114 may be made of a similar or the same material.

First connection holes (not shown) enabling the locations of the antenna pattern 112 on which the contact terminals 115 are formed to be exposed are formed in the prepared second protective film 114.

The second protective film 114 is bonded to be in close contact with a portion, in which the antenna pattern 112 is exposed, using a laminating method so that the locations of the first connection holes (not shown) and the locations of the antenna pattern 112 on which the contact terminals 115 are formed are aligned.

Further, the contact terminals 115 are plated so that the transmission of signals can be desirably performed by making electrical contact.

In this case, as a plating material, any one selected from a group including gold, silver, and lead can be used.

The antenna sheet 11 may further include an absorber (not shown) formed on the bottom surface of the second protective film 114 in which the contact terminals 115 are located in the antenna sheet 11.

The absorber (not shown) is an electromagnetic absorber capable of attenuating electromagnetic waves so as to solve electromagnetic problems occurring on RF communication products, and may be applied in the form of ink or attached in the form of a film.

That is, the absorber (not shown) may be formed on the bottom surface of the second protective film 114 by forming second connection holes (not shown) at the locations of the plurality of contact terminals 115 so that the absorber is applied in the form of ink or attached in the form of a film to attenuate electromagnetic waves.

By way of example, a film-type absorber can be manufactured using hot press equipment after soft magnetic metal powder corresponding to any one kind selected from among Sendust (Fe—Si—Al) and carbonyl iron (Fe—C) has been mixed with silicone rubber, and then the manufactured film-type absorber can be used.

Meanwhile, as shown in FIG. 5, when the antenna pattern 112 includes two antenna patterns of the first antenna 1121 and the second antenna 1122, a first antenna absorber and a second antenna absorber may be formed on the bottom surface of the second protective film 114 in which the contact terminals 115 are located in the antenna sheet 11 so that the first and second antenna absorbers are included in the first antenna band and the second antenna band, respectively, of the two antenna patterns in order to effectively cause electromagnetic attenuation depending on the frequency bands of the respective antennas.

Accordingly, the embodiments of the present invention is advantageous in that there is no need to take into special consideration of a space for accommodating various types of antennas when designing a mobile communication terminal, and in that variations attributable to antenna characteristics are not large and there are fewer limitations imposed on the design of the external appearance of a plurality of mobile communication terminal casings having an antenna function.

Further, the embodiments of the present invention is advantageous in that manufacturing costs of implementing one or more antennas are greatly reduced, and the utilization of the inner space of a mobile communication terminal can be improved because antennas are formed within the mobile communication terminal casing using injection molding. One or more of an M-Commerce functional antenna that uses a 13.56 MHz band, a GPS antenna, an NFC antenna, a DMB antenna, a WiFi antenna, a Bluetooth antenna, an FM transceiver antenna, and a UWB antenna are mounted, and thus various functions can be implemented on the mobile communication terminal.

Furthermore, the embodiments of the present invention are advantageous in that the formation of electrodes is simplified and an injection molding procedure does not influence the electrodes, thus greatly decreasing a defective proportion. As a result, the present invention solves the problems that may occur because injection molding is performed on the surface on which the electrodes are formed, that is, the problems in that it is difficult to form electrodes, it is complicated to insert the electrodes, and then a defective proportion is high.

Although the embodiments of the present invention have been disclosed for illustrative purposes, those skilled in the art will appreciate that various modifications, additions and substitutions are possible, without departing from the scope and spirit of the invention as disclosed in the accompanying claims.

A plurality of other embodiments in addition to the above embodiments are included in the accompanying claims of the present invention.

What is claimed is:

1. An antenna-integrated casing of a mobile communication terminal, the casing comprising:

an injection-molded casing comprising an exterior surface and an interior surface facing away from the exterior surface, the injection-molded casing comprising a recess stepped from the interior surface;

an antenna sheet comprising a first surface and a second surface facing away from the first surface, the antenna sheet further comprising an antenna pattern, a protective film, and at least one contact terminal between the first and second surfaces, wherein the antenna sheet is received in the recess of and integrated with the injection-molded casing such that the first surface of the antenna sheet faces the injection-molded casing and the second surface of the antenna sheet faces away from the injection-molded casing and further such that the antenna pattern is interposed between the protective film and the injection-molded casing, wherein the at least one contact terminal is exposed on the second surface and electrically connected to the antenna pattern through the protective film.

2. The casing of claim 1, wherein the second surface of the antenna sheet is substantially in the same plane as the interior surface of the injection-molded casing.

3. The casing of claim 1, wherein the recess and the antenna sheet are substantially in the same size.

4. The casing of claim 1, wherein the antenna sheet comprises at least one through-hole formed therethrough, wherein the at least one through-hole is filled with a material of the injection-molded casing.

5. The casing of claim 1, wherein the antenna sheet further comprises an electromagnetic absorber film on at either side or both sides of the antenna pattern.

6. The casing of claim 5, wherein the antenna sheet comprises at least one through-hole formed through the electromagnetic absorber film, wherein the at least one through-hole is filled with a material of the injection-molded casing.

7. The casing of claim 5, wherein the antenna sheet comprises a binder layer that provides the first surface, wherein the binder layer is in contact with the injection-molded casing.

8. The casing of claim 1, wherein the antenna sheet further comprises another protective film, wherein the antenna pattern is interposed between the two protective films.

9. The casing of claim 8, wherein the antenna sheet comprises at least one through-hole formed through the two protective films, wherein the at least one through-hole is filled with a material of the injection-molded casing.

10. The casing of claim 8, wherein the antenna sheet comprises a binder layer formed over the other protective film, wherein the binder layer is in contact with the injection-molded casing.

11. The casing of claim 10, wherein the antenna sheet comprises at least one through-hole formed through the two protective films and the binder layer, wherein the at least one through-hole is filled with a material of the injection-molded casing.

12. The casing of claim 1, wherein the antenna pattern comprises a first antenna designed for a first band and a second antenna designed for a second band that is different from the first band.

13. The casing of claim 12, wherein the at least one contact terminal comprises two or more contact terminals, each of which is exposed on the second surface through the protective film.

14. The casing of claim 1, wherein the antenna sheet comprises one or more antenna selected from the group consisting of a Mobile (M)-Commerce functional antenna designed for a 13.56 MHz band, a Near-Field Communication (NFC) antenna, a Digital Multimedia Broadcasting (DMB) antenna, a WiFi antenna, a Global Positioning System (GPS) antenna, a Bluetooth antenna, a Frequency Modulation (FM) transceiver antenna, and an Ultra-Wideband (UWB) antenna.

15. The casing of claim 1, wherein the at least one contact terminal comprises two or more is exposed on the second surface through the protective film.

16. A method of making an antenna-integrated casing, the method comprising:

providing a first mold comprising a first die and a second die;

providing an antenna sheet comprising a first surface and a second surface facing away from the first surface, the antenna sheet further comprising an antenna pattern, a protective film, and at least one contact terminal between the first and second surfaces, the at least one contact terminal exposed on the second surface and electrically connected to the antenna pattern through the protective film;

placing the antenna sheet between the first die and the second die such that the first die, the second die and the antenna sheet together define a mold space; and injecting a resin material into the mold space to form an injection-molded casing that receives the antenna sheet in a recess and is integrated with the antenna sheet to provide the antenna-integrated casing of claim 1.

17. The method of claim 16, wherein the first die comprising a substantially flat surface, wherein the antenna sheet is placed between the first die and the second die such that the second surface of the antenna sheet contacts the substantially flat surface.

18. The method of claim 16, wherein the antenna sheet comprises at least one through-hole formed therethrough, wherein the first die comprises a resin-injection hole formed through the substantially flat surface, wherein the at least one through hole of the antenna sheet is aligned with the at least one hole of the first die, wherein the resin material is injected into the mold space through the at least one resin-injection hole and further through the at least one through-hole of the antenna sheet.

19. The method of claim 18, wherein the substantially flat surface is larger than the second surface of the antenna sheet.

20. The method of claim 16, wherein the antenna sheet further comprises another protective film such that the antenna pattern is interposed between the two protective films, wherein the antenna pattern comprises one or more antennae.

* * * * *